US006168253B1

(12) United States Patent
Miyagawa et al.

(10) Patent No.: US 6,168,253 B1
(45) **Date of Patent: *Jan. 2, 2001**

(54) INK-JET HEAD USING SEALANT AND INK-JET APPARATUS USING THE INK-JET HEAD

(75) Inventors: Masashi Miyagawa, Yokohama; Masahiko Higuma, Tougane, both of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/772,775

(22) Filed: Dec. 24, 1996

(30) Foreign Application Priority Data

Dec. 28, 1995 (JP) ..... 7-343087
Nov. 29, 1996 (JP) ..... 8-319517

(51) Int. Cl.[7] ..... B41J 2/015
(52) U.S. Cl. ..... 347/20
(58) Field of Search ..... 347/45, 47, 20

(56) References Cited

U.S. PATENT DOCUMENTS 4,323,488 * 4/1982 Takago et al. ..... 528/32

FOREIGN PATENT DOCUMENTS 495678 1/1992 (EP) .
495678A2 * 7/1992 (EP) .
648605A2 * 4/1995 (EP) .
46-30711 * 9/1971 (JP) .
58-10418 * 1/1983 (JP) .
59-524 * 1/1984 (JP) .
7-232439 * 9/1995 (JP) .

* cited by examiner

*Primary Examiner*—John Barlow
*Assistant Examiner*—Michael S Brooke
(74) *Attorney, Agent, or Firm*—Fitzpatrick, Cella, Harper & Scinto

(57) ABSTRACT

The present invention provides an ink-jet head and an ink-jet apparatus using the ink-jet head. The liquid-ink-contacting sections of the ink-jet head are sealed with a moisture-curing sealant essentially consisting of a silicone-modified organic polymer compound. In the molecular structure, the silicone-modified organic polymer compound has carbon atoms modified with alkoxysilane. The moisture-curing sealant contains an organo-tin or organo-titanium catalyst having the alkoxy and/or carboxyl groups, the alkyl chain of the alkoxy group has 5 or fewer carbon atoms, and the alkyl chain of the carboxyl group has 6 or fewer carbon atoms.

13 Claims, 3 Drawing Sheets

INK-JET HEAD USING SEALANT AND INK-JET APPARATUS USING THE INK-JET HEAD

BACKGROUND OF THE INVENTION

1. Field of the Invention

The present invention relates to an ink-jet head using a sealant and an ink-jet apparatus provided with the ink-jet head.

2. Description of the Related Art

According to ink-jet printing systems, small drops of ink are produced to adhere onto a medium, such as paper, and printing is advantageously conducted at a high speed with extremely low noise using very small-sized ink-jet heads. Thus color printing is readily achieved by using small sized apparatuses. According to one of the ink-jet printing systems, ink is bubbled by a heating element and jetted by utilizing the bubble growth. FIGS. 1 and 2 show an ink-jet head used for this type of ink-jet printing system.

FIG. 1 diagrammatically shows a discharge element on an ink-jet head. FIG. 2 is a sectional diagram showing the surroundings of an ink passage of an ink-jet head equipped with the discharge element shown in FIG. 1.

A silicon substrate 1001 is provided with a heating element which generates energy for discharging ink, and is fixed by die bonding to a base plate 1004 made of aluminum or the like. A printed wiring board 1003 for contact with a recorder is installed on the base plate 1004 such that the silicon substrate 1001 and the printed wiring board 1003 are electrically connected by wire bonding. In addition to the heating element, a shift register for driving and a wiring pattern are provided on the silicon substrate 1001 such that, together with the heating element, they are manufactured within the silicon substrate 1001 by a silicon forming technique. The printed wiring substrate 1003 is provided with a contact pad (not shown in the figure) for contact with an ink-jet apparatus. Concave portions to be used as an ink passage 1002*e* and an ink chamber 1002*b* are integrally formed as a top plate 1002 by injection molding. The top plate 1002 is fixed to the silicon substrate 1001 by a spring or the like to form the ink passage 1002*e* and the ink chamber 1002*b*. The top plate 1002 has an ink-discharge opening formed by laser processing.

The top plate and the silicon substrate 1001 of the above ink-jet head 1002 are joined by a spring. Thus uniform adhesion between the wall of the ink passage 1002*e* and the silicon substrate 1001 may be impaired by warping of the top plate 1002 or dust present between the top plate 1002 and the silicon substrate 1001, resulting in ink leakage. A sealant is injected into the joining interface of the top plate 1002 and the silicon substrate 1001 to avoid the above ink leakage. In addition to the ink-jet head, the sealant is injected into the joining portions of members forming the ink passage. FIG. 2 shows an example of a sealant 801 injected in spaces between members. A member 802 for forming an ink passage and an ink tank 803 are fixed on a base plate 807 by caulking-pins in FIG. 2.

Conventionally, one-pack type moisture-curing silicone resins have been used as sealants for ink-jet heads and ink-jet apparatuses because of the following reasons: the silicone sealants exhibit high ink-durability and adherence; are curable by moisture; have suitable viscosity and tack free time. For stable and simple production of the ink-jet head, it is essential to use the one-pack type moisture-curing silicone resin as a sealant for ink-jet heads and ink-jet apparatuses.

In other words, since numerous members are used in an ink-jet head, it is difficult to seal spaces using thermoplastic resins or thermosetting resins. If a two-pack type resin is employed, production-engineering becomes extremely difficult because it is necessary to mix the two parts immediately before use and to apply the resultant mixture within a certain time-period. The moisture-curing resin enters into the spaces between the construction members of an ink-jet head due to capillarity action. If there is no space to enter, the moisture-curing resin stops flowing, forms a meniscus, and cures. Thus advantageously, the sealant reliably enters where it is expected to seal and does not enter where it is not expected to seal.

It is important to prevent bubbles from entering ink-jet heads. In other words, if bubbles enter an ink passage or an ink chamber inside an ink-jet head, the ink-discharge energy may be absorbed by the bubbles and stable ink discharging may be impaired, or the ink supply may be stopped by the bubble, resulting in a shortage of the ink supply. Conventionally, when an ink-jet head contains bubbles the bubbles are removed by suction with a recovery pump provided in an ink-jet apparatus. Even if the bubbles are removed, the above disadvantageous phenomenon reoccurs when bubbles are not completely prevented from entering and are allowed to gradually enter into spaces. Therefore, frequent recovery operations are necessary for ink-jet heads to avoid the above disadvantage. Recently, the volumes of ink tanks and members absorbing the used ink have decreased because of a demand for small-sized apparatuses. Therefore, it is necessary to make the number of recovery operations as small as possible. From the above viewpoint, the prevention of bubble-entry is an important object.

From investigations conducted on how bubbles enter into ink-jet heads, it was revealed that the bubbles predominantly entered through the sealant. In other words, because of a large bond length between a silicon atom and a carbon atom or other kinds of atoms, organosilicone compounds which have been conventionally used as sealants have relatively higher permeability to gases; thus, they are not always advantageous in preventing bubble from entering. It was, however, impossible to avoid bubble-entry by employing general-purpose organic polymer compounds as the sealant for ink-jet heads and ink-jet apparatuses, in spite of the fact that the permeability of the general-purpose organic polymer compounds to gases was 100 or more lower than that of silicone polymer compounds. This is because very few organic polymer compounds are moisture-curing and even if they are moisture-curing, they hardly have satisfactory ink resistance and sufficient adhesion to members.

In view of the above-described bubble-entry problems, Japanese Patent Application No. 6-241094 discloses a method of using a one-pack type moisture-curing material as a sealant. In this related art, an organic compound modified with silicone, in particular, a polyether polyol, is used as a base resin for the one-pack type moisture-curing material. The organic compound modified with silicone acquires moisture-curing characteristics according to a method such that silicone compounds having the alkoxy groups are added to the molecular terminals. The alkoxy groups are readily hydrolyzed and decomposed into silanol by moisture. Silanol, which is extremely unstable, is polymerized into a gel by the addition of a catalyst, such as organo-tin.

Recently, the pH of ink used for ink-jet apparatuses tends to be higher (i. e. highly alkaline) because of the following reasons: Ink used for ink-jet apparatuses is expected to be highly water-proof to maintain excellent printing quality even if the printed media gets wet. The use of dyes which are soluble in only alkaline aqueous solutions is one means for providing excellent water-proofing of ink. In this case, ink is required to be highly alkaline to dissolve the dyes.

Urea is occasionally added to ink as a moisture retention component to prevent the moisture contained in the ink from evaporating so that the ink does not solidify around the discharge openings. When urea is left to stand, it decomposes into ammonia, thereby raising the pH of the ink.

It was found that the high pH of ink resulted in another problem as follows: In general, the organic silicone-modified polymer compounds contain an organo-tin catalyst to acquire their moisture-curing characteristics. As the organo-tin catalyst, 0.5 to 3 wt % of dibutyltin dilaurate is generally used, which accelerates the condensation of the hydrolyzed alkoxysilane to achieve gelation. However it was found that dibutyltin dilaurate was very readily hydrolyzed by alkaline ink, and further, lauric acid generated by the hydrolysis was precipitated by reaction with alkaline metal ions frequently added to ink, such as lithium and sodium ions. Therefore, when highly alkaline ink was employed, precipitates occasionally formed due to the organo-tin catalyst contained in conventional sealants, resulting in blockage of nozzles.

SUMMARY OF THE INVENTION

Accordingly, it is an object of the present invention is to provide a sealant which can replace one-pack type moisture-curing silicone sealants and which can prevent bubbles from entering into ink passages so as to achieve stable discharge and decrease the number of the recovery-pump operations. More particularly, it is an object of the present invention to improve the catalyst used for the organic silicone-modified polymer compound to be applicable to ink-jet recording apparatuses by avoiding precipitation caused by hydrolysis of the catalyst.

For achieving the above objects, the present invention provides an ink-jet head. The liquid-ink-contacting sections of the ink-jet head are sealed with a moisture-curing sealant essentially consisting of a silicone-modified organic polymer compound. In the molecular structure, the silicone-modified organic polymer compound has carbon atoms modified with alkoxysilane. The moisture-curing sealant contains an organo-tin or organo-titanium catalyst having alkoxy and/or carboxyl groups, the alkyl chain of the alkoxy group has 5 or fewer carbon atoms, and the alkyl chain of the carboxyl group has 6 or fewer carbon atoms.

According to the present invention, the amount of bubbles entering through the sealant can be reduced and the nozzle blockage caused by the reaction products between the ink and the catalyst of the sealant is preventable. Therefore, it becomes possible to provide reliable ink-jet heads in smaller sizes.

DESCRIPTION OF THE PREFERRED EMBODIMENT

Figure 1:
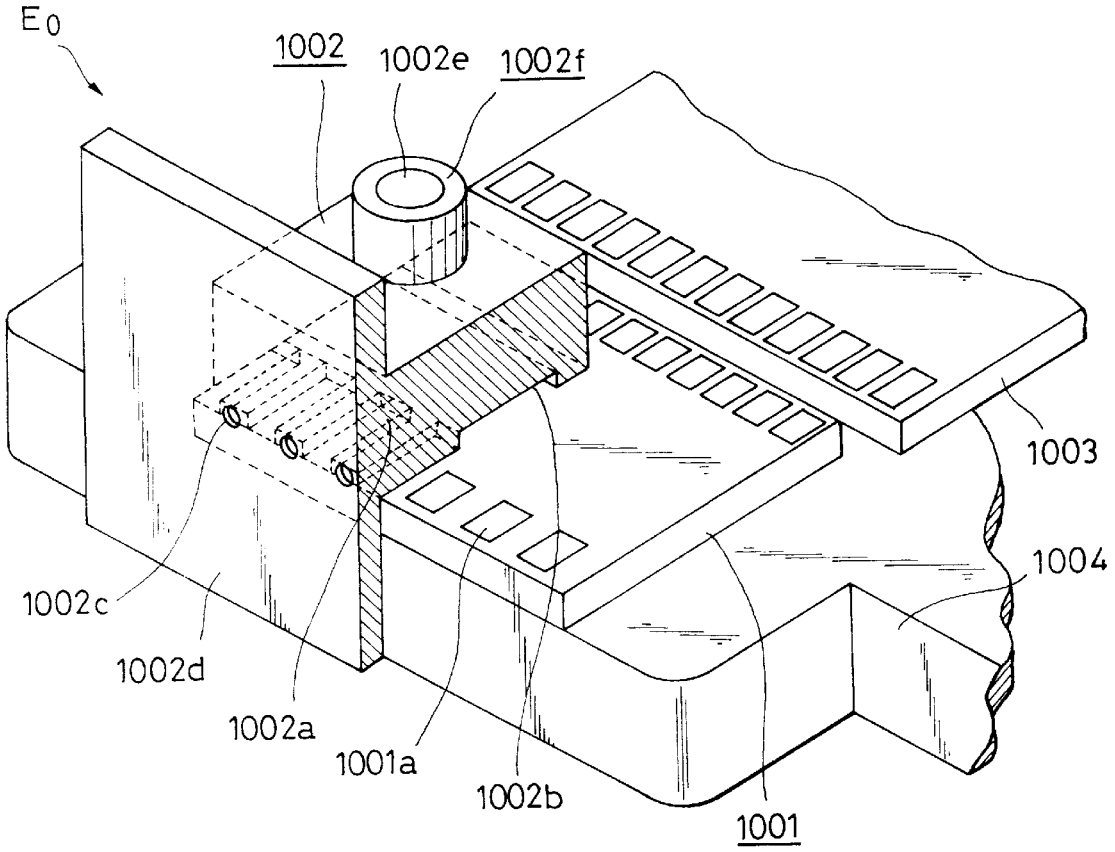
FIG. 1 is a diagram showing a construction of a discharge element of an ink-jet head.

The present invention will be understood in detail from the following description of the preferred embodiments taken in conjunction with the accompanying drawings.

First, the organic silicone-modified polymer compound will be explained. General-purpose organic polymer compounds can be made moisture-curable by modifying the compounds with a silicone polymer compound having an alkoxy group. The addition of a silane coupling agent is one of the most simple silicone-modification techniques. The silane coupling agent has an alkoxy group and groups that are reactive with the organic polymer compounds, such as vinyl, epoxy, amino, methacrylic, acrylic, and mercapto groups; and it modifies the organic polymer compounds to be moisture-curable in a simple manner.

However, to obtain a sealant having stable viscosity and a tack free time, it is necessary to add an alkoxysilane to the organic polymers under conditions in which the alkoxy group is not decomposed. In other words, the alkoxy groups added to the silicon atoms are extremely unstable such that they are readily decomposed by a small quantity of moisture. Thus, to add an alkoxysilane to the organic polymer compounds, the reaction conditions and the molecular structure of the resulting compound are restricted.

From the above viewpoint, the use of polyvalent isocyanate, as is described in Japanese Examined Patent Publication No. 46-30711, is one of the most preferred techniques for modifying organic polymer compounds with silicone. Since isocyanate is highly reactive with the active hydrogen in the hydroxyl group or the amino group and forms a urethane bond or a urea bond, an alkoxysilane can be added to the organic polymers by using isocyanate. Although any polymer can be used as the polymer compound in so far as it has the hydroxyl group or the amino group in its molecule, polyols which are employed as a raw material of polyurethane are preferable among generally used polymers. The general-purpose isocyanate compounds which are also used as the raw material for urethane are preferably employed as the polyvalent isocyanate. Any silane compound can be employed for silicone modification, as long as it has an alkoxy group, or a group which is reactive to isocyanate, such as a silyl, silanol, amino, or hydroxy group. The alkoxy group may be a methoxy, ethoxy, or propoxy group. Among these, the methoxy group is most preferable because it is readily hydrolyzed and can be obtained at low cost. Although 1 to 3 alkoxy groups can be contained in one molecule, 2 or 3 groups are preferable to achieve a stable tack free time and physical properties for curing.

Practical examples of the alkoxy group are dimethoxymethylsilane, trimethoxysilane, dimethylethoxysilane, diethoxysilane, diethoxymethylsilane, triethoxysilane, 3-aminopropyltrimethoxysilane, 2-aminoethylaminomethyltrimethoxysilane, and the like.

Various structures of silane compounds have been synthesized recently and are expected to be synthesized in the future. According to the present invention, a silicone-modified resin employed as a sealant for an ink-jet head is prepared by utilizing the reaction of isocyanate with a silyl (H-Si), silanol, amino, or hydroxy group. Thus, any type of bond is applicable, particularly between the alkoxysilane and the amino or hydroxy group.

The above sealant can be synthesized in a simple manner such that polymers having the hydroxy group at their terminals react with an excess amount of diisocyanate and transform into polymers having the isocyanate group at their terminals, followed by a reaction with an alkoxysilane. In addition, the storage stability of the sealant is improved, since no moisture is produced from the above reactions, and moisture, as an impurity, in the reaction systems is removed by reacting with isocyanate.

Japanese Examined Patent Publication Nos. 58-10418 and 59-524 describe another method for modifying organic polymer compounds with an alkoxysilane, in which a polymer compound having the allyloxy group reacts with an alkoxysilane having the mercapto or alkenyloxy group. The structure of the organic polymer compound modified with an alkoxysilane is defined as a structure in which the polymer compound and the alkoxysilane are linked by sharing an ether bond.

An organic polymer compound can be prepared as follows: Polymers having the hydroxy group at their molecular terminals react with allyl chloride to form vinyl ether. As a result, unsaturated double bonds are formed at the molecular terminals. Then, an alkoxysilane, mercaptoalkoxysilane, or alkenyloxy-containing silane is added to the unsaturated double bonds by using a catalyst, such as platinum, according to a general purpose reaction. Examples of the alkoxy-containing silicone compound used for the above reaction are: the afore-described alkoxysilanes; mercapto-group containing silanes, such as dimethoxy-3-mercaptosilane and 3-mercaptopropyltrimethoxysilane; and alkoxysilanes having unsaturated double bonds, such as methoxydimethylvinylsilane, trimethoxyvinylsilane, and diethoxymethylvinylsilane.

Although any organic polymer compound can be modified with silicone and used as the principal chain as long as the compound has a hydroxy group at the molecular terminals, polyether polyols are most preferably used. This is because polyether polyols have relatively higher alkali resistance and low viscosity, which are advantageous properties for a sealant for ink-jet heads. However, when using a polyether polyol as a sealant for ink-jet heads, consideration must be given to the water-absorption properties of the sealant because polyether polyols are highly hydrophilic. If the sealant has extremely high water-absorption properties, the adhesion strength between the sealant and the structural members of an ink-jet head is lowered by water absorption, occasionally resulting in ink leakage. The water absorption properties can be reduced by increasing the ratio of carbon atoms to oxygen atoms contained in the polyether polyol. Thus, polyether propanol and polyether butanol show relatively lower water absorption than polyether glycol. Since the characteristics of polyether polyols affect the viscosity of the sealant, it is desirable to select a suitable polyether polyol giving consideration to its water-absorption properties.

As an essential element of the present invention, catalysts will be explained below.

The sealant used for the present invention is gelled by condensation polymerization of an organic polymer compound modified with silicone, in which the reaction is activated by an organo-tin catalyst, as is mentioned above. Dibutyltin dilaurate which has been used as a conventional organo-tin catalyst is not suitable for a sealant of ink-jet heads and ink-jet apparatuses because it forms precipitates in an alkaline solution. From earnest studies, the inventors of the present invention have found that, even in an alkaline solution, precipitation is avoidable under the following conditions: an organo-tin catalyst having an alkoxy group is used; a long-chain alkyl group bonded to the alkoxy group has 5 or fewer carbon atoms; and preferably, a tin catalyst having the following formula (1) is used:

(1)

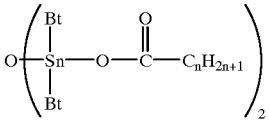

wherein Bt is a butyl group and n is an integer of from 1 to 4.

In other words, when the long-chain alkyl group bonded to the alkoxy group of the tin catalyst has 5 or fewer carbon atoms, the solubility of the reaction product between an organic acid produced by hydrolysis due to a tin catalyst and alkaline metal ions with respect to ink increases, and thus precipitation is preventable. For example, when dibutyltin diacetate is used as the tin catalyst which has a long-chain alkyl group having 5 or fewer carbon atoms, the reaction product between the tin catalyst and the ink is lithium acetate which exhibits extremely high solubility. Thus precipitates are not formed even if lithium ions are contained in the ink. Moreover, lithium acetate is frequently added to the ink as a buffer and does not impair the discharge characteristics of ink-jet heads.

In addition to the organo-tin catalyst, the inventors of the present invention have investigated the application of an organo-titanium catalyst to moisture-curing sealants essentially consisting of an organic polymer compound which is modified with silicone and which has carbon atoms modified with an alkoxysilane. Consequently, the same results as the above organo-tin catalyst were obtained from investigation of the organic titanium catalyst. In general, organo-titanium compounds are divided into three types, i.e., titanium acylate compounds, tetraalkoxysilane compounds, and titanium chelate compounds. Each of these organo-titanium compounds has an alkoxy group and produces an alcohol with hydrolysis. It was also found that if the long-chain alkyl group bonded to the alkoxy group of the catalyst had 6 or more carbon atoms, the solubility of the resulting alcohol to the ink decreased and precipitates were readily formed, thereby causing bubbles and deteriorated printing. In addition to the alkoxy group, the titanium acylate compounds have the carboxyl group, and it became apparent that if the long-chain alkyl group bonded to the carboxyl group of the catalyst had 7 or more carbon atoms, as is similar to the alkoxy group, the carboxyl group produced by hydrolysis reacted with the metal ions in the ink, resulting in precipitation.

The titanium chelate compounds have the following formulae:

$$(R'OR')_2Ti(OR)_2,\ (H_2NRO)_2Ti(OR)_2$$

wherein R and R' are alkyl. In addition to the alkoxy group, they have an amino group and other groups. Since the amino group and other groups contain nitrogen and oxygen atoms, they exhibit high solubility. Thus, any structure is acceptable for the substituent added by an amino bond.

Therefore, to be used as an organo-titanium catalyst, the long-chain alkyl group bonded to the alkoxy group of the catalyst should have 5 or fewer carbon atoms, and the long-chain alkyl group bonded to the carboxyl group of the catalyst should have 6 or fewer carbon atoms. The titanium acylate compounds of the following formula (2), the tetraalkoxysilane compounds of the following formula (3), and the titanium chelate compounds of the following formula (4) are preferable:

$$Ti(OC_kH_l)_m(OCOC_nH_l)_{4-m} \quad (2)$$

$$Ti(OC_kH_l)_4 \quad (3)$$

$$(HORO)_mTi(OC_kH_l)_{4-m} \quad (4)$$

wherein n is an integer of from 1 to 4, k is an integer of from 1 to 6, m is an integer of from 1 to 3, l is an integer, and R is alkyl.

Practical examples of the titanium compound are tetraisopropoxy titanium, tetra-n-butoxy titanium, titanium acetylacetonate, iso-propoxy(2-ethylhexanediolate) titanium, and triethanolamine titanate.

When a tin catalyst or a titanium catalyst each of which has short alkyl chains is used, the tack free time of the sealant is occasionally prolonged because of low catalytic activity. If a large quantity of catalyst is added to the sealant to achieve a shorter tack free time, the cost of the sealant increases and the storage stability of the sealant decreases. In other words, even though the tack free time is shortened by using a large quantity of catalyst, it is very difficult to maintain reaction activity of the organic silicone-modified polymer compounds for long durations because such compounds basically have low reactivity.

As a result of in-depth study, the inventors of the present invention have found that a relatively shorter duration of tack free time is achievable when a polyfunctional organic silicone-modified polymer compound is employed for providing the resin with a branched structure to improve the gelation characteristics of the resulting resin. In practice, the polyfunctional organic polymer compound has three or more carbon atoms having the alkoxysilyl group in one molecule to increase the degree of crosslinking. In other words, the organic polymer compound has three or more alkoxysilane groups of the following formula (5) in one molecule:

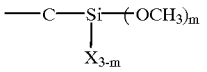

(5)

wherein X is hydrogen, halogen, or alkyl; and m is an integer of from 1 to 3.

In the present invention, one carbon atom is allowed to have 1 to 3 alkoxysilane groups, and the carbon atom to which the alkoxysilane groups are added is defined as one functional group. It became apparent that a polyfunctional sealant having 3 or more functional groups had excellent resin-curing characteristics, and thus a short tack free time and excellent storage stability were achieved even if the catalyst was added at 1% or less.

Further, the degree of crosslinking in the resin also increased by using the polyfunctional organic polymer compounds modified with silicone, thereby improving the heat resistance and alkali resistance of the resulting resin.

In the above organic polymer compounds modified with silicone, the organic polymer and the silicone-modified carbon atom are preferably linked by a urethane bond of the following formula (6a), a urea bond of the following formula (6b), or an ether bond of the following formula (7).

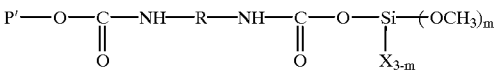

(6a)

-continued

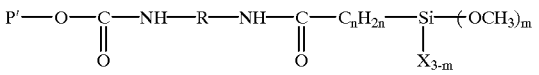

(6b)

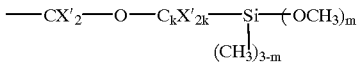

(7)

wherein P' is the principal chain of an organic polymer; R is the alkyl chain, from which —HCO of diisocyanate is removed; X is hydrogen, halogen, or alkyl; m is an integer of from 1 to 3; n is an integer of from 0 to 4; X' is H, $CH_3$, or $CH_2$; and k is an integer of from 1 to 5.

When a polyfunctional sealant was prepared using a branched polyether polyol, the resulting sealant occasionally had high viscosity, but the problem is revealed to be avoidable by narrowing the molecular-weight distribution of the polyether polyol. This is because the viscosity of the resulting resin is predominantly determined by the polymer content, and the viscosity of the sealant can be remarkably reduced by removing the polymer content so as to narrow the molecular-weight distribution. According to the present invention, the preferable average molecular-weight (Mw) is 30,000 or less and the preferable degree of dispersion (Mw/Mn) is 3 or less to control the viscosity of the sealants. The molecular-weight distribution can be measured with a general-purpose GPC apparatus. The molecular-weight distribution is controlled by fractionating the synthesized polymer materials according to the molecular weight or by distilling away the low-molecular compounds. According to the molecular-weight fractionation, a resin having the desired molecular weight can be synthesized such that a polymer material is dissolved in a good solvent, e.g., tetrahydrofuran, and then precipitated from n-hexane.

Examples and comparative examples of the present invention will be described below:

EXAMPLE 1

To 100 parts of a polyether polyol resin (manufactured by Kishida Chemical Co., Ltd.) having a molecular weight of 3,000, was added 120 parts of tetramethylenedisocyanate (manufactured by Kishida Chemical Co., Ltd.), followed by a reflux of 4 hours at 180° C. for reacting isocyanate with the hydroxy group contained in polyethylene glycol. Isocyanate was thereby added to both terminals of the polymers in the resin. In addition, by reacting with water in the reaction system, the excess isocyanate advantageously removed the water. Then, 80 parts of γ-aminopropyltrimethoxysilane (manufactured by Shin-Etsu Silicone Co., Ltd.) was added to the resultant and reacted at 100° C. for 2 hours. According to the above procedures, the polymers could be modified with silicone such that isocyanate added to both terminals of the polymer reacted with the amino group of an alkoxysilane and formed a urea bond. A sealant was then prepared by adding 2 wt % of dibutyltin diacetate (manufactured by Kishida Chemical Co., Ltd.) as a curing catalyst to the resulting resin. The viscosity of the resulting resin was 13,000 cps and the tack free time thereof was 40 min.

EXAMPLE 2

A moisture-curing sealant modified with silane using a urethane bond was used in this example.

A polymer compound having three or more hydroxy groups in one molecule was prepared according to a method similar to Example 1 and subjected to a reaction with tetramethylenediisocyanate. Then, 80 parts of trimethoxysilane (manufactured by Shin-Etsu Silicone Co., Ltd.) was added to the resultant, followed by stirring at 80° C. for 2 hours to synthesize a silicone-modified resin. A sealant was then prepared by adding 1 wt % of dibutyltin acetate and 1 wt % of trimethylamine to the resulting resin.

EXAMPLE 3

A moisture-curing sealant modified with silane using an ether bond was used in this example.

A polymer compound having three or more hydroxy groups in one molecule was prepared in a manner similar to Example 1 and subjected to a reaction with allyl chloride (manufactured by Kishida Chemical Co., Ltd.) according to a conventional method. As a result, a polymer compound having an allyloxy group at the molecular terminals was synthesized. The resulting resin was then subjected to a reaction with dimethoxysilane using a platinum catalyst. The resulting resin had a similar structure to Kaneka MS polymer (manufactured by Kaneka Corporation). Similar to Example 1, a sealant was prepared by adding a tin catalyst and an amine catalyst to the resulting resin.

EXAMPLE 4

In this example, a recording head was manufactured using a material the tack free time of which was shortened by employing a silicone-modified polymer compound having a branched structure in the molecule.

A sealant having three silicone-modified carbon atoms in one molecule was synthesized as follows. All reagents were obtained from Kishida Chemical Co., Ltd., unless otherwise specified.

To 100 parts of ethylene glycol and 5 parts of glycerin, was added 0.5 parts of sodium methoxide for reacting at 0° C. for 24 hours. The resulting resin was dissolved in 500 parts of tetrahydrofuran and then precipitated from methanol. The average molecular-weight (Mw) of the resulting resin was 5,000 and the degree of dispersion (Mw/Mn) was 2.3 based on measurements using a GPC analyzer (manufactured by Shimadzu Corporation). The resulting resin was a polymer compound having three hydroxy groups in one molecule. The principal chain of the polymer was oxyethylene and was partially branched by glycerin.

Similar to Example 1, the polymer compound was modified with silicone, and then one part of dibutyltin diacetate was added thereto for preparing a sealant. The tack free time of the resulting sealant was 15 min.

COMPARATIVE EXAMPLES 1 AND 2

In Comparative Example 1, a sealant was prepared according to a method similar to Example 1, except that, instead of dibutyltin diacetate, the same quantity of dibutyltin dilaurate was used as the tin catalyst. In Comparative Example 2, Super-X (manufactured by Cemedine Co., Ltd.) was employed as the sealant.

EXAMPLES 5 TO 9, AND COMPARATIVE EXAMPLES 3 AND 4

Moisture-curing sealants were prepared according to a method similar to Example 1, except that organo-titanium catalysts shown in Table 1 were used in the corresponding Examples and Comparative Examples instead of the organotin catalyst.

The ink resistance of each of the resultant sealants was evaluated as follows: Each sealant was dripped on a Teflon plate at a diameter of 30 mm and a thickness of 3 mm and then left for 1 week at room temperature. The resultant was immersed for one month at 60° C. into clear ink having the following composition for observation of the ink. Precipitation of the sealant caused by the reaction with the ink resulted in cloudy ink.

| Ink Composition (pH 11.0) | |
|---|---|
| Water | 80 parts |
| Glycerin | 5 parts |
| Diethylene glycol | 5 parts |
| Urea | 5 parts |
| Sodium hydroxide | 1 part |
| Isopropyl alcohol | 4 parts |

In the above ink resistance test, sealants of the Examples 1 to 9 caused no change in the ink, however, cloudy ink was shown by the use of sealants of the Comparative Examples 1 to 4.

Figure 2:
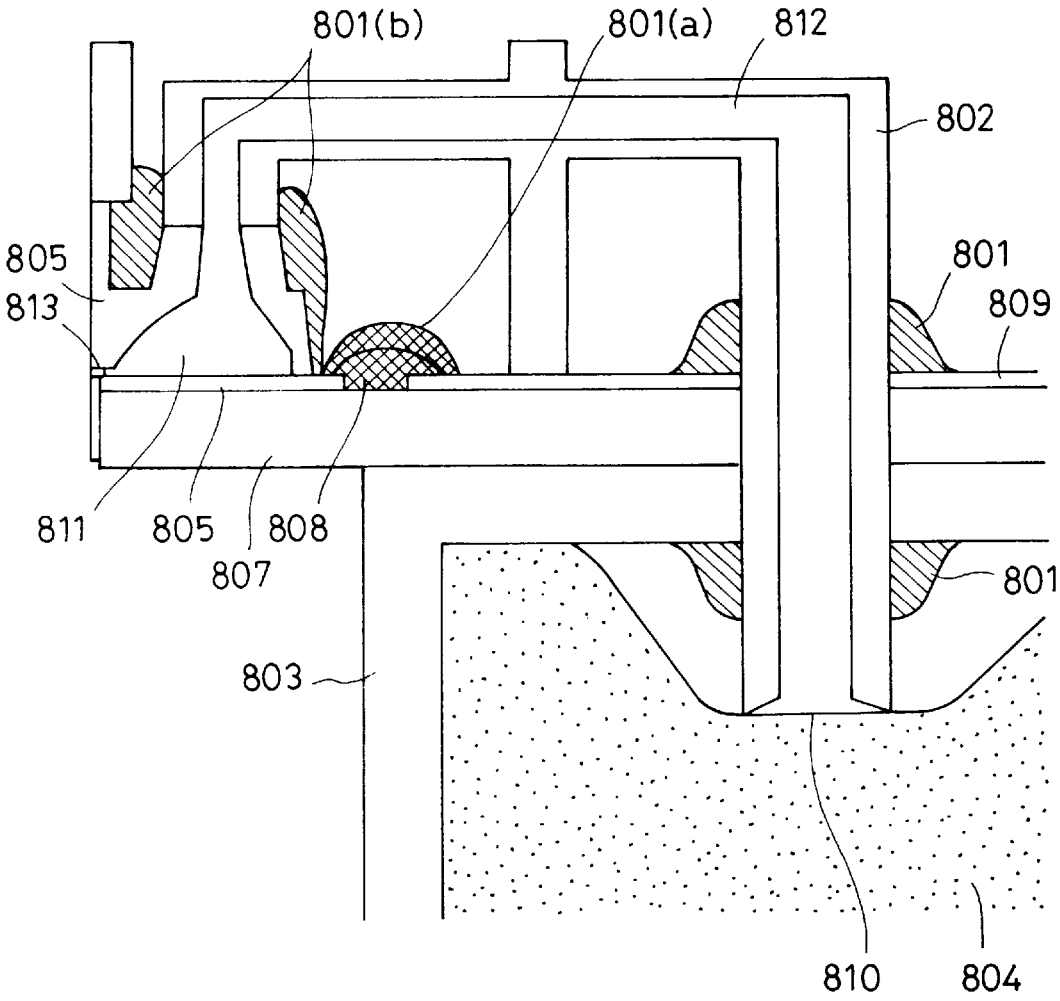
FIG. 2 is a sectional diagram showing the surroundings of an ink passage of an ink-jet head employing the discharge element shown in FIG. 1.

Next, using the moisture-curing sealants obtained from the Examples and the Comparative Examples, the corresponding ink-jet heads were fabricated as follows:

By die bonding, a substrate which had been provided with a heater and a driver beforehand by a general-purpose silicon processing was fixed on an aluminum base plate laminated with a printed wiring board, as is shown in FIG. 1. An ink passage, an ink chamber, and nozzles were provided for a polysulfone resin top-plate by injection-molding and then an ink-discharging opening was formed in the top plate by an excimer laser. The top plate was fixed to the substrate by a spring so that the ink-discharging opening was arranged to the most preferable position with respect to the heater. After fixing ink furnishing members to the base plate by heated caulk, the sealant was injected. By using a dispenser, the sealant was injected into the ink-jet head which was inclined 30° and fixed by a jig maintained at 40° C. FIG. 2 shows a sealant injected to an ink-jet head. A sealant 801 was filled in the joining interface between a top plate 805 and a ink-furnishing member 802 and an interface between the top plate 801 and a heater substrate 806, and cured therein. The sealant did not enter a nozzle 813 or an ink chamber 811 formed on the top plate 805. As is shown in FIG. 1, an ink tank was fixed to the base plate by heated caulk, and ink was poured into the ink tank to complete the ink-jet head fabrication.

Figure 3:
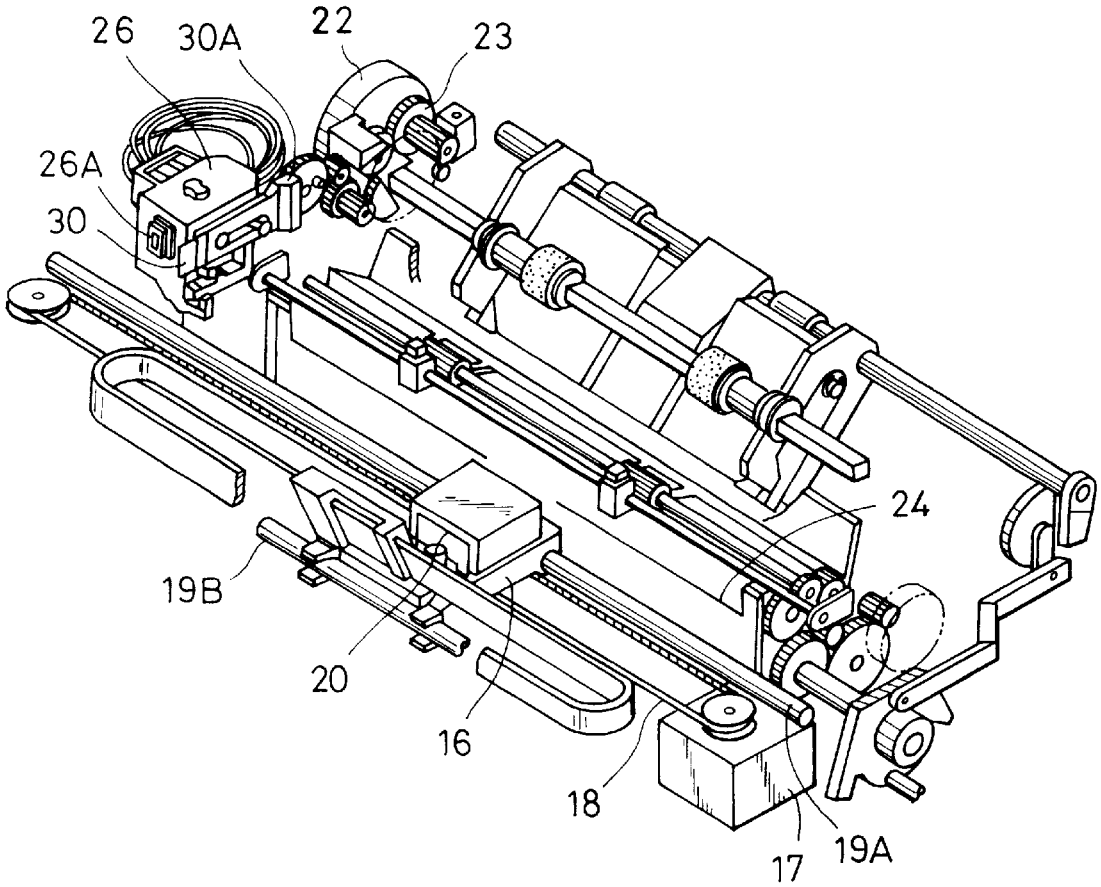
FIG. 3 is a diagram showing an embodiment of an ink-jet apparatus incorporated in the present invention.

Each of the resulting ink-jet heads was subjected to a heat cycle test. In one cycle of the heat cycle test, each of the ink-jet heads was maintained at −30° C., at room temperature, and at 60° C., respectively for 2 hours each, and 10 cycles were conducted for one test. The ink-jet heads were then installed in an ink-jet apparatus shown in FIG. 3 and printing was evaluated for each ink-jet head 3 and 5 days after the installation. FIG. 3 shows an ink-jet head 20 and a vacuum pump 26 which is set up at a home position of the ink-jet apparatus for vacuum-recovering the ink-jet head 20 via a cap 26A. In the above tests, a dye (4 parts of Food Black) was added to the ink.

The ink-jet heads fabricated using the sealants of Examples 1 to 9 revealed excellent results on printing conducted 3 and 5 days after the installation. In the ink-jet heads fabricated by using the sealants of Comparative Examples 1 to 4, ink discharge was impaired during printing conducted 3 days after the installation. This phenomenon was considered to be due to precipitation which as produced from the reaction between the sealants and the ink and which clogged the discharge opening.

TABLE 1

| EXAMPLES | ORGANIC TITANIUM COMPOUNDS | FORMULAE |
|---|---|---|
| EXAMPLE 5 | TETRAISOPROPOXY TITANIUM | $Ti(O—iC_3H_7)_4$ |
| EXAMPLE 6 | TETRA-n-BUTOXY TITANIUM | $Ti(O—nC_4H_9)_4$ |
| EXANPLE 7 | TITANIUM ACETYLACETATE | $Ti(O—iC_3H_7)_2(OC(CH_3)CHCOCH_3)_2$ |
| EXAMPLE 8 | ISOPROPOXY(2-ETHYLHEXANEDIOLATE)TITANIUM | $Ti(O—iC_3H_7)_n[OCH_2CH(C_2H_5)CH(OH)C_3H_7]_{4-n}$ |
| EXAMPLE 9 | TRIETHANOLAMINE TITANATE | $Ti(O—_nC_4H_9)_2[OC_2H_4N(C_2H_4OH_2)]_2$ |
| COMPARATIVE EXAMPLE 3 | TETRAKIS-2-ETHYLHEXOXY TITANIUM | $Ti[OCH_2CH(C_2H_5)C_4H_9]_4$ |
| COMPARATIVE EXAMPLE 4 | TETRASTEAROXY TITANIUM | $Ti(O—C_{18}H_{37})_4$ |

What is claimed is:

1. An ink-jet head comprising a top plate and a silicon substrate, joined to form liquid-ink contacting sections, said liquid-ink contacting sections being sealed with a one-pack moisture curing sealant which comprises a silicone-modified organic polymer compound as a main component, said silicone-modified organic polymer compound having carbon atoms modified with alkosiloxane, wherein said one-pack moisture curing sealant contains an organ-tin or organo-titanium catalyst having alkoxy and/or carboxyl groups, each bonded to an alkyl chain, the alkyl chain bonded to the alkoxy group has 5 or fewer carbon atoms, and the alkyl chain bonded to the carboxyl group has 6 or fewer carbon atoms.

2. An ink-jet head according to claim 1, wherein said moisture-curing sealant contains an organo-tin catalyst having the following formula (1);

(1)

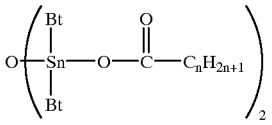

in which Bt is a butyl group and n is an integer of from 1 to 4; or one of organo-titanium catalysts having the following formulae (2) to (4):

$$Ti(OC_kH_l)_m(OCOC_nH_l)_{4-m} \quad (2)$$

$$Ti(OC_kH_l)_4 \quad (3)$$

$$(HORO)_mTi(OC_kH_l)_{4-m} \quad (4)$$

in which n is an integer of from 1 to 4, k is an integer of from 1 to 6, m is an integer of from 1 to 3, is an integer, and R is alkyl.

3. An ink-jet head according to claim 2, wherein said silicone-modified organic polymer compound has 3 or more alkoxysilane groups of the following formula (5):

(5)

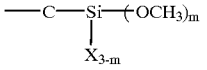

in which X is hydrogen, halogen, or alkyl, and m is an integer of from 1 to 3.

4. An ink-jet head according to claim 3, wherein said silicone-modified organic polymer compound comprises a polyether polyol.

5. An ink-jet head according to claim 4, wherein said sealant has an average molecular weight of 30,000 or less and a degree of dispersion (Mw/Mn) of 3 or less.

6. An ink-jet head according to claim 3, wherein said silicone-modified organic polymer compound comprises an organic polymer compound and a silicone-modified carbon atom linked by sharing a urethane bond of the following formula (6a) or a urea bond of the following formula (6b):

(6a)

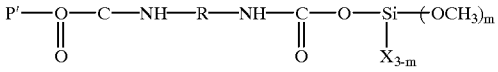

(6b)

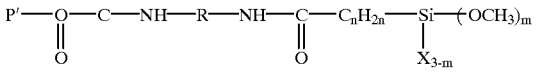

wherein P' is a principle chain of said organic polymer compound; R is an alkyl chain containing a diisocyanate from which an —HCO group is removed; X is hydrogen, halogen, or alkyl; m is an integer of from 1 to 3; and n is an integer of from 0 to 4.

7. An ink-jet head according to claim 6, wherein said sealant has an average molecular weight of 30,000 or less and a degree of dispersion (Mw/Mn) of 3 or less.

8. An ink-jet head according to claim 3, wherein said silicone-modified organic polymer compound comprises an organic polymer compound and an alkoxysilane linked by sharing an ether bond of the following formula (7):

(7)

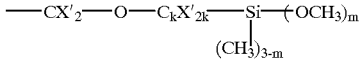

in which X' is H, $CH_3$, or $CH_2$; m is an integer of from 1 to 3; and k is an integer of from 1 to 5.

9. An ink-jet head according to claim 8, wherein said sealant has an average molecular weight of 30,000 or less and a degree of dispersion (Mw/Mn) of 3 or less.

10. An ink-jet head according to claim 3, wherein said sealant has an average molecular weight of 30,000 or less and a degree of dispersion (Mw/Mn) of 3 or less.

11. An ink-jet head according to claim 1, wherein said ink-jet head further comprises an ink tank unit for keeping ink to be supplied to said ink-jet head.

12. An ink-jet head according to claim 1, wherein said liquid-ink-contacting sections sealed with said sealant include:

a joining interface between a member, which forms an ink chamber and a nozzle, and a substrate comprising an energy generating element;

a joining interface between a member, which forms an ink chamber and a nozzle, and a member of an ink passage; and a joining interface between a member of an ink passage and said ink tank unit.

13. An ink-jet apparatus comprising:

an ink-jet head according to one of claims 1 to 12 or 5 to 9; and means for recovering said ink-jet head.

* * * * *

UNITED STATES PATENT AND TRADEMARK OFFICE

CERTIFICATE OF CORRECTION

PATENT NO. : 6,168,253 B1
DATED : January 2, 2001
INVENTOR(S) : Masashi Miyagawa et al.

It is certified that error appears in the above-identified patent and that said Letters Patent is hereby corrected as shown below:

Column 2,
Line 15, “bubbles” should read -- bubbles, --.

Column 7,
Line 7, “1 is” should read -- 1 is --.

Column 10,
Line 65, “as” should read -- was --.

Column 11,
Line 7, “EXANPLE 7” should read -- EXAMPLE 7 --.
Line 48, “is” (second occurrence) should read -- 1 is --.

Column 14,
Line 2, “1 to 12 or 5 to” should read -- 1 to 12; --.
Line 3, “9; and” should read -- and --.

Signed and Sealed this

Twenty-seventh Day of August, 2002

*Attest:*

*Attesting Officer*

JAMES E. ROGAN
*Director of the United States Patent and Trademark Office*